US006350011B1

(12) United States Patent
Karlinski

(10) Patent No.: US 6,350,011 B1
(45) Date of Patent: Feb. 26, 2002

(54) PRINT HEAD ARRANGEMENT

(75) Inventor: Haggai Karlinski, Ramat Gan (IL)

(73) Assignee: Aprion Digital Ltd., Netanya (IL)

( * ) Notice: Subject to any disclaimer, the term of this patent is extended or adjusted under 35 U.S.C. 154(b) by 0 days.

(21) Appl. No.: 09/649,022

(22) Filed: Aug. 28, 2000

(30) Foreign Application Priority Data

Sep. 7, 1999 (IL) ..... 131830

(51) Int. Cl.[7] ..... B41J 2/145; B41J 2/15; B41J 2/155

(52) U.S. Cl. ..... 347/40; 347/42

(58) Field of Search ..... 347/42, 40

(56) References Cited

U.S. PATENT DOCUMENTS 4,593,295 A * 6/1986 Matsufuji et al. ..... 347/43

6,027,203 A * 2/2000 Campbell ..... 347/42

* cited by examiner

*Primary Examiner*—Thinh Nguyen

(74) *Attorney, Agent, or Firm*—Eitan, Pearl, Latzer & Cohen-Zedek

(57) ABSTRACT

An arrangement employing multiple print heads displaced laterally for printing on a substrate moving relative to the arrangement in a given direction of relative motion has N print heads, where N is at least four, deployed sequentially along the direction of relative motion with a displacement $X_0$ between adjacent print heads. The sequence of lateral offsets between successive print heads is chosen such that the maximum displacement measured parallel to the direction of relative motion between any two print heads which generate adjacent points in the printed output is no greater than $(N/2)X_0$, and is preferably no greater than $2X_0$.

2 Claims, 3 Drawing Sheets

PRINT HEAD ARRANGEMENT

FIELD AND BACKGROUND OF THE INVENTION

The present invention relates to print heads and, in particular, it concerns an arrangement of print heads for reducing distortions in the printed output.

Contemporary high resolution inkjet printers are required to produce resolutions of at least 300 dots per inch (DPI), and typically 600 DPI or greater. However, the construction of the nozzles making up a print head, such as for example a piezoelectric inkjet print head, typically limits the physical proximity between the nozzles to at least one, or even two, orders of magnitude greater than would be required to achieve the required resolution directly.

To overcome this limitation, conventional inkjet printers employ a staggered array to achieve the required resolution. The extent of stagger between the various rows is such that, as the paper moves, the traces of ink drops from the various nozzles define non-overlapping, equally-spaced parallel lines. The spacing of these lines determines the effective resolution of the head. For a 600 DPI inkjet printer, a typical example employs at least 4 staggered rows of nozzles. The timing of the ejection of drops from any one row relative to any other row is made to be equal to the time of paper travel between the rows in question. Thus, for example, in order to print a solid horizontal line at a given vertical position on the paper, each row of nozzles is made to eject an ink drop when the given paper position passes opposite that row.

For reasons of efficient manufacturing and servicing, it is preferable to divide a large single-unit print head into several identical smaller print heads, together forming a print head arrangement. FIG. 1 shows schematically an example of an inkjet print head arrangement 10 of this type having a number of print heads 12*a,* 12*b* etc. For simplicity of description, the arrangement is assumed to have 7 print heads, each with 8 staggered rows of nozzles. The seven print heads are staggered relative to each other so as to result in a full 600 DPI print coverage across the width of paper fed in a predefined feed direction.

For clarity of presentation, the structure of FIG. 1 is represented schematically in FIG. 2 by a set of seven staggered identical single-row print heads. The resulting dots timed to fall at the same X-position on the substrate form a printed line 14.

A major shortcoming of this structure is the tendency of the arrangement to cause misregistration in the printed output. As the paper is moved under the head arrangement in direction 16, the dots labeled g and h, which are adjacent in the printed output 14, are generated by nozzles at opposite extreme ends of the arrangement. The long paper travel distance between these end points often gives rise to a slight overlap or gap between adjacent dots forming line 14 due to variations in the paper positioning or paper distortion due to wet paper contraction and different ink drying times. The result is a "wavy" rather than straight line output.

There is therefore a need for a print head arrangement which would reduce the distance between dot-generating elements corresponding to adjacent dots in a printed output.

SUMMARY OF THE INVENTION

The present invention is a print head arrangement.

According to the teachings of the present invention there is provided, an arrangement of print heads for printing on a substrate moving relative to the arrangement in a given direction of relative motion, the arrangement comprising: a number N of similar print heads where N is at least equal to four, each of the print heads being configured to selectively print a pattern of dots such that relative motion of the print head and the substrate defines a virtual pattern of printable parallel lines, the virtual pattern having a minimum period of repetition D as measured in a direction perpendicular to the direction of relative motion, wherein the print heads are deployed sequentially along the direction of relative motion with a displacement $X_0$ between adjacent ones of the print heads measured parallel to the direction of relative motion, the print heads being offset relative to a given reference position in a direction perpendicular to the direction of relative motion by $nY_0$, where n is an integer value from 0 to (N−1) and $Y_0$=D/N, any two of the print heads which have offsets differing by $Y_0$ or $(N-1)Y_0$ being referred to as "functionally adjacent print heads", and wherein the sequence of offsets of the print heads is chosen such that a maximum displacement $\Delta X_{max}$ measured parallel to the direction of relative motion between any two functionally adjacent print heads is no greater than $(N/2)X_0$.

Preferably, the sequence of offsets of the print heads is chosen such that the maximum displacement $\Delta X_{max}$ measured parallel to the direction of relative motion between any two functionally adjacent print heads is no greater than $2X_0$.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is an arrangement of print heads.

The principles and operation of print head arrangements according to the present invention may be better understood with reference to the drawings and the accompanying description.

Figure 3:
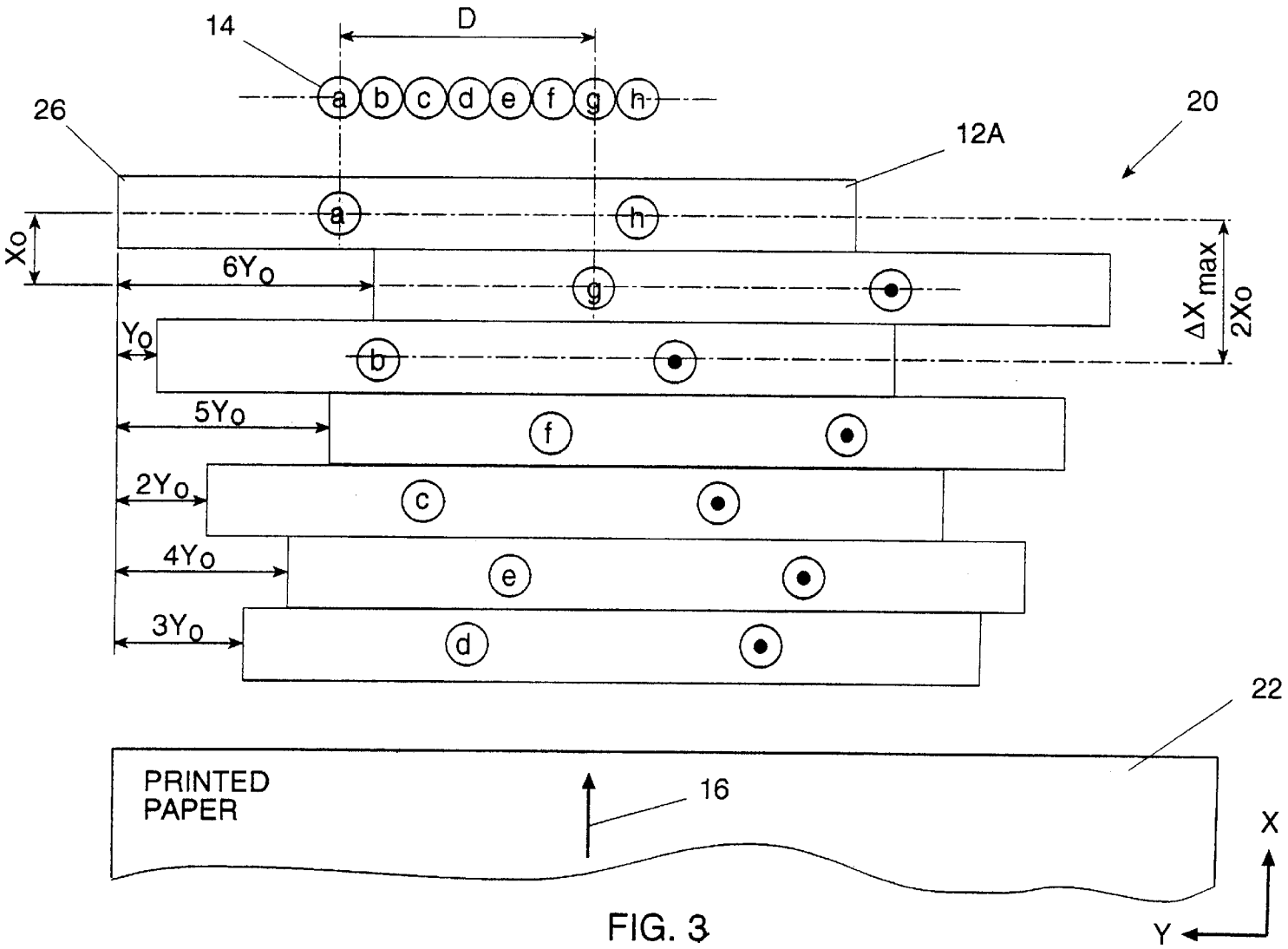
FIG. 3 is a schematic representation of a print head arrangement constructed and operative according to the teachings of the present invention.

Referring now to the drawings, FIG. 3 shows schematically an arrangement of print heads, generally designated 20, constructed and operative according to the teachings of the present invention, for printing on a substrate 22 moving relative to the arrangement in a given direction of relative motion 16.

Figure 1:
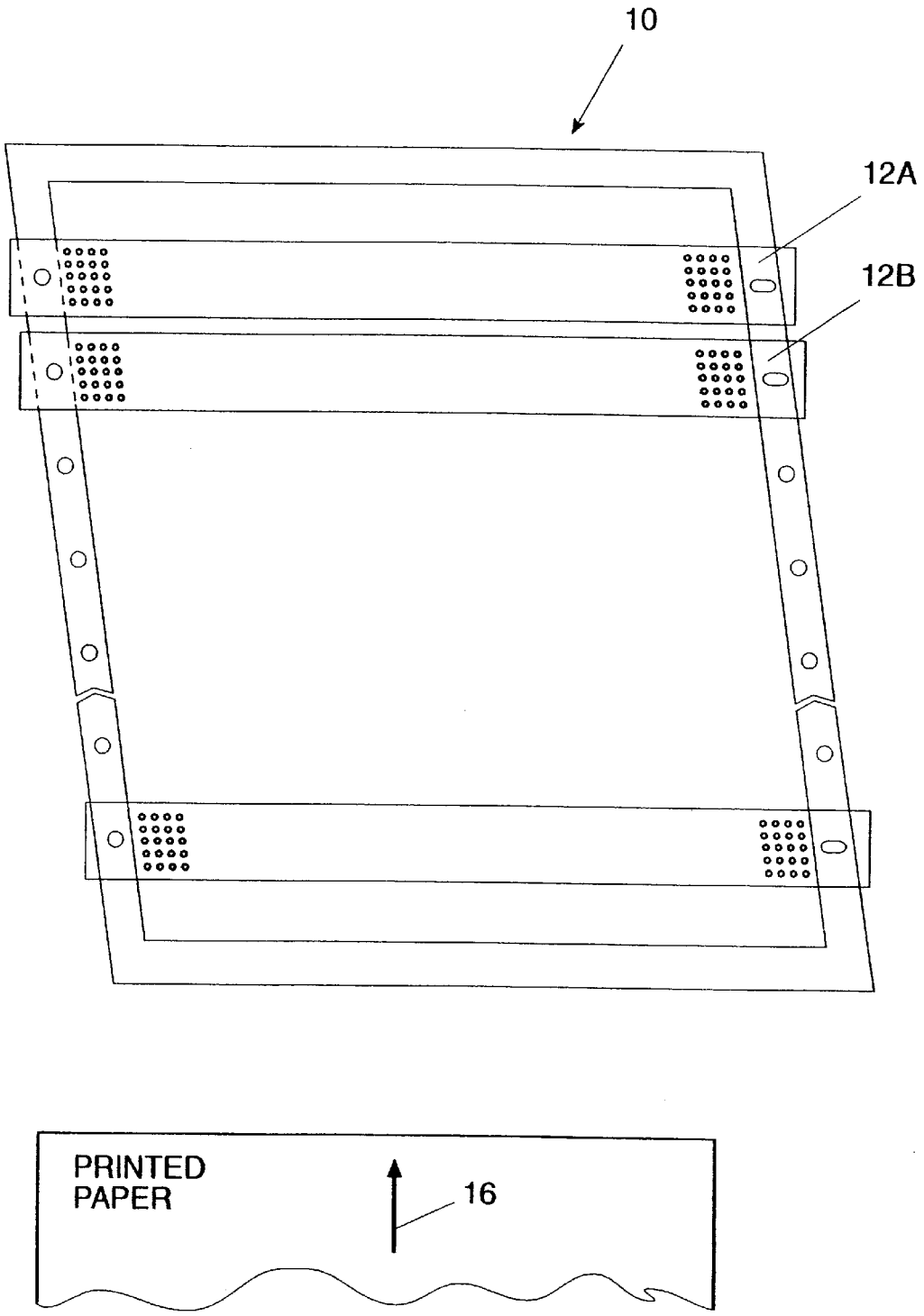
FIG. 1 (PRIOR ART)
FIG. 1 is a print head arrangement according to the teachings of the prior art.

Arrangement 20 includes N similar print heads 26, N being at least four and, in the case shown here, seven. Each print head 26 is configured to selectively print a pattern of dots such that relative motion between the print head and the substrate defines a virtual pattern of printable parallel lines, the virtual pattern having a minimum period of repetition D as measured in a direction perpendicular to the direction of relative motion. For a nozzle layout of the type shown in FIG. 1, D is typically equal to the distance between nozzles of the same row.

Print heads 26 are deployed sequentially along direction of relative motion 16 with a displacement $X_0$ between adjacent print heads 26 as measured parallel to direction of relative motion 16. In the direction perpendicular to the direction of relative motion 16, print heads 26 are offset relative to a given reference position by $nY_0$, where n is an integer value from 0 to (N−1) and $Y_0$=D/N. Any two of print heads 26 which have offsets differing by $Y_0$ or $(N-1)Y_0$ are referred to as "functionally adjacent print heads" (i.e., print heads that will print adjacent dots on line 14).

Figure 2:
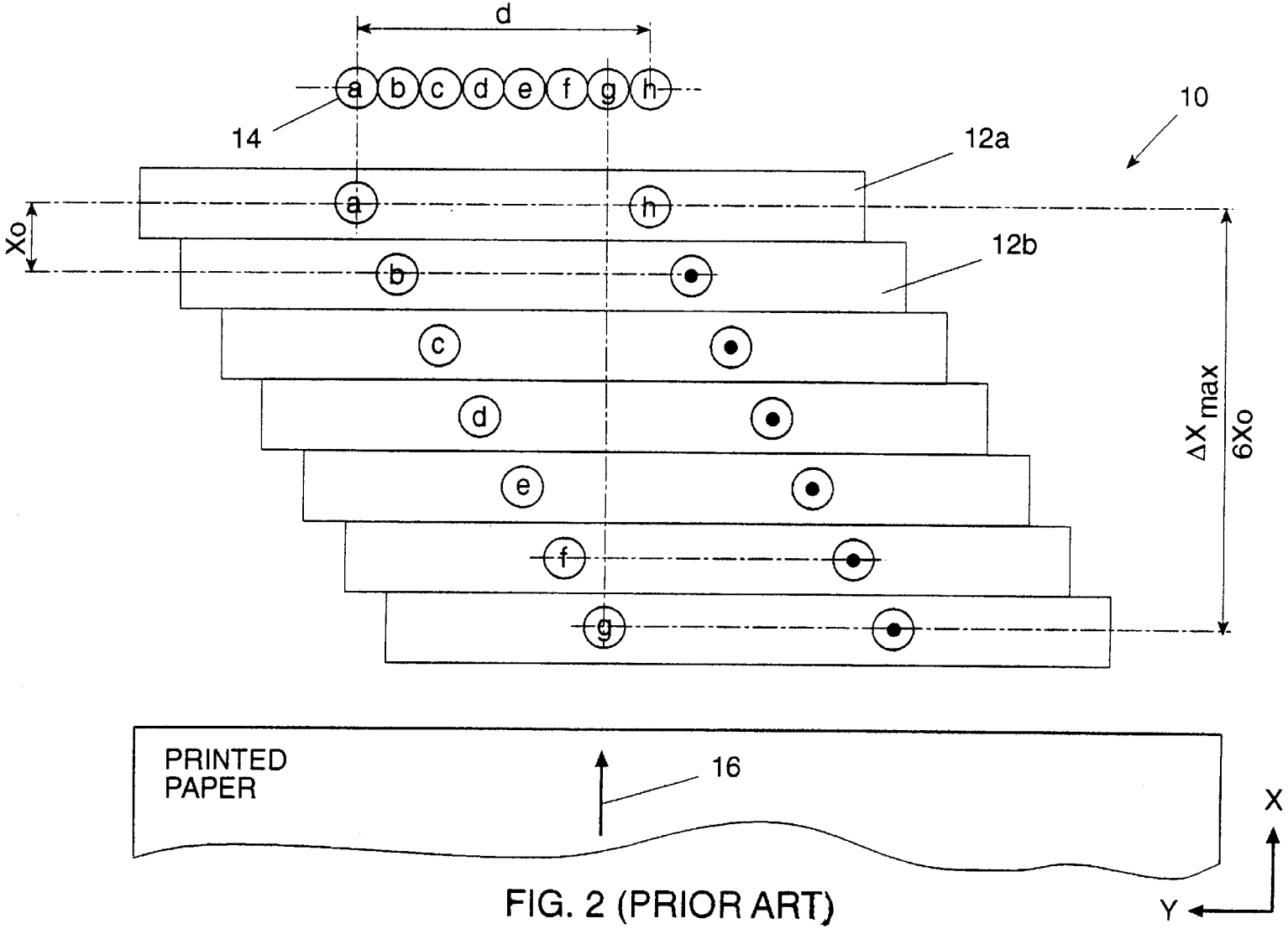
FIG. 2 (PRIOR ART)
FIG. 2 is a simplified schematic equivalent of FIG. 1 illustrating the cause of misregistration.

It will be noted that, according to this terminology, the displacement ΔX measured in the X-direction (parallel to direction of relative motion 16) between the functionally adjacent print heads generating dots g and h of FIG. 2 is $(N-1)X_0$. In contrast, it is a particular feature of the present invention that the sequence of offsets of print heads 26 is chosen such that a maximum displacement $\Delta X_{max}$ measured parallel to direction of relative motion 16 between any two functionally adjacent print heads 26 is no greater than $(N/2)X_0$, and is preferably no greater than $2X_0$.

It will be readily apparent that the present invention provides a profound reduction in printed dot misalignment. Specifically, for the illustrated example of seven print heads, both the distance and time delay between printing of adjacent points is reduced to a third of the corresponding values for the conventional arrangement. Furthermore, any misalignment occurring is likely to be similar for several adjacent pairs of lines within each period D, typically reducing any distortion to dimensions not readily apparent to the eye.

Referring now in more detail to FIG. 3, it will be noted that the principle underlying the sequence of staggering or offsets of printing heads in the Y-direction used here may be used for any number of print heads from four upwards to ensure a maximum X-direction displacement between functionally adjacent print heads 26 of no more than $2X_0$. Specifically, from a first print head positioned in an arbitrary starting position, the next two successive print heads are offset by $\pm Y_0$, i.e., one to the right and one to the left. In this context, it should be noted that the virtual pattern of lines from each print head is periodic with a period D. As a result, an offset of $(D-Y_0)$, (which may be expressed as $(N-1)Y_0$), is equivalent to an offset of $-Y_0$ (disregarding the end nozzles of each row). Each successive print head is then given an offset corresponding to $Y_0$ beyond the offset of the print head two previously and in the same direction. This continues until all of the print heads have been deployed.

The result is an alternating stepped pattern of offsets in which a first set of alternate print heads (in this example, 1, 3, 5 and 7) form a sequence of increasing offsets while a second set of alternate print heads, interspersed with the first (in this example, 2, 4 and 6), form a sequence of decreasing offsets. The two sequences converge to functionally adjacent print heads in the first two head positions, and similarly in the last two positions, thereby ensuring that no two functionally adjacent print heads are separated in the X-direction by more than $2X_0$.

It should be noted that, while the aforementioned pattern of offsets is considered optimal, various other patterns also fall within the scope of the present invention. Specifically, any pattern which reduces the maximum displacement $\Delta X_{max}$ measured parallel to direction of relative motion 16 between any two functionally adjacent print heads to no greater than $(N/2)X_0$ will provide considerable reduction of misalignment problems over the layout of FIG. 2 described above.

Finally, it should also be noted that the present invention is applicable to a wide range of printer configurations where relative motion is generated in one or more direction between an array of inkjet print heads and a substrate. The relative motion may be generated by movement of the substrate, or of the substrate, or both. Where a two-dimensional scanning motion is used, the direction referred to herein as "the direction of relative motion" is the direction in which continuous printing is performed.

It will be appreciated that the above descriptions are intended only to serve as examples, and that many other embodiments are possible within the spirit and the scope of the present invention.

What is claimed is:

1. An arrangement of print heads for printing on a substrate moving relative to the arrangement in a given direction of relative motion, the arrangement comprising:

a number N of similar print heads where N is at least equal to four, each of said print heads being configured to selectively print a pattern of dots such that relative motion of said print head and the substrate defines a virtual pattern of printable parallel lines, said virtual pattern having a minimum period of repetition D as measured in a direction perpendicular to the direction of relative motion, wherein said print heads are deployed sequentially along the direction of relative motion with a displacement $X_0$ between adjacent ones of said print heads measured parallel to the direction of relative motion, said print heads being offset relative to a given reference position in a direction perpendicular to the direction of relative motion by $nY_0$, where n is an integer value from 0 to (N−1) and $Y_0$=D/N, any two of said print heads which have offsets differing by $Y_0$ or $(N-1)Y_0$ being referred to as "functionally adjacent print heads", and wherein the sequence of offsets of said print heads is chosen such that a maximum displacement $\Delta X_{max}$ measured parallel to the direction of relative motion between any two functionally adjacent print heads is no greater than $(N/2)X_0$.

2. The arrangement of claim 1 wherein the sequence of offsets of said print heads is chosen such that said maximum displacement $\Delta X_{max}$ measured parallel to the direction of relative motion between any two functionally adjacent print heads is no greater than $2X_0$.

* * * * *